US005312102A

United States Patent [19]

Stennett

[11] Patent Number: 5,312,102

[45] Date of Patent: May 17, 1994

[54] VARIABLE INERTIA HEAD RACKET

[75] Inventor: Patrick Stennett, Springfield, Mass.

[73] Assignee: Lisco, Inc., Del.

[21] Appl. No.: 13,528

[22] Filed: Feb. 4, 1993

[51] Int. Cl.[5] ..... A63B 49/02

[52] U.S. Cl. ..... 273/73 C

[58] Field of Search ..... 273/73 R, 73 C, 73 G

[56] References Cited

U.S. PATENT DOCUMENTS

| | | | |
|---|---|---|---|
| Re. 31,419 | 10/1983 | Frolow . | |
| Re. 33,372 | 10/1990 | Frolow . | |
| D. 243,467 | 2/1977 | Kouvelas . | |
| D. 256,823 | 9/1980 | James . | |
| 1,539,019 | 5/1925 | Nikonow . | |
| 2,171,223 | 8/1939 | Robinson . | |
| 2,220,935 | 11/1940 | Le Compte et al. . | |
| 2,282,195 | 5/1942 | Le Compte . | |
| 2,626,804 | 1/1953 | Robinson . | |
| 4,165,071 | 8/1979 | Frolow . | |
| 4,177,990 | 12/1979 | Kajiwara . | |
| 4,220,335 | 9/1980 | Nobbs . | |
| 4,280,699 | 7/1981 | Drake . | |
| 4,291.574 | 9/1981 | Frolow . | |
| 4,478,416 | 10/1984 | Gibello . | |
| 4,561,655 | 12/1985 | Mortvedt . | |
| 4,662,634 | 5/1987 | Winkler . | |
| 4,664,380 | 5/1987 | Kuebler . | |
| 4,690,405 | 9/1987 | Frolow . | |
| 4,768,786 | 9/1988 | Kuebler . | |
| 4,834,383 | 5/1989 | Woehrle et al. . | |
| 4,903,967 | 2/1990 | Ferrari et al. . | |
| 4,911,444 | 3/1990 | Yoneyama | 273/73 C |
| 4,919,438 | 4/1990 | Yoneeyama . | |
| 4,997,186 | 3/1991 | Carr . | |
| 5,014,987 | 5/1991 | Soong . | |
| 5,048,830 | 9/1991 | Lo . | |
| 5,071,124 | 12/1991 | Davis . | |
| 5,076,583 | 12/1991 | Hsu . | |
| 5,080,361 | 1/1992 | Blanc et al. . | |
| 5,110,125 | 5/1992 | Blanc . | |
| 5,158,288 | 10/1992 | Chen et al. . | |
| 5,183,265 | 2/1993 | Umlauft et al. | 273/73 C |
| 5,211,691 | 5/1993 | Sol | 273/73 C |

*Primary Examiner*—Vincent Millin
*Assistant Examiner*—Raleigh W. Chiu

[57] ABSTRACT

A tennis racket comprising a head formed as a closed loop at the upper end, a handle for being gripped by a player at the lower end and coupling beams therebetween, the head being formed with varied inertial cross-sectional configurations around its periphery with a nearly circular cross-sectional configuration at the upper edge of the head and the lower edge of the head and with an oval wide-beam cross-sectional configurations at the sides of the head between the 2 and 5 o'clock positions and the 7 and 10 o'clock positions for generating a stiffness that is about 70% of the other sections which have nearly circular cross-sectional configuration and strings in a plane secured in the head.

4 Claims, 5 Drawing Sheets

| MATERIAL | DIMENSION(MM) WIDTH-LENGTH | FAW G/M$^2$ (PLIES-F.A.W. | PART WEIGHT |
|---|---|---|---|
| NYLON BLADDER | | | 8.0 |
| C19 | 100 - 1600 (1760) | 2-110 | 64.0 (70.4) |
| C0<br>C30 | 65 - 100<br>65 - 100 | 1 -110<br>2 -110 | 1.3<br>2.6 |
| C0 | 65 - 1600 | 1 - 150 | 28.4 |
| C30 | 60 - 1300 | 2 -110 | 31.2 |
| C90 | 20 - 800 | 1 -150 | 4.3 |
| C30 | 70 - 1600 (1700) | 2 -110 | 44.8 (47.5) |
| C0 | 60 - 200 | 2 - 150 | 6.5 |

| MATERIAL | DIMENSION(MM.) WIDTH-LENGTH | F.A.W. G/M 2 (PLIES-F.A.W. | PART WEIGHT |
|---|---|---|---|
| C30 | 20-350 | 2-110 | 2.8 |
| C30 | 70-100 | 2-110 | 2.7 |
| C30 | 70-120 | 2-110 | 3.3 |
| C30 | 20-190 | 4-110 | 3.0 |
| C30 | 20-190 | 4-110 | 3.0 |
| C90 | 20-190 | 1-150 | 1.0 |
| C30 | 50-160 | 8-110 | 12.8 |
| CO | 50-160 | 4-110 | 6.4 |
| C30 | 100-50 | 2-110 | 2.0 |
| CO | 100-500 | 1-150 | 1.4 |

VARIABLE INERTIA HEAD RACKET

BACKGROUND OF THE INVENTION

1. Field of the Invention

This invention relates to a varied inertia head racket and, more particularly, to a tennis racket having a frame fabricated of a composite material with a cross-sectional configuration forming an air foil mid-head and essentially circular above and below whereby the frame will create minimum shock and vibration when striking a ball.

2. Description of the Background Art

In tennis, players use rackets to strike a resilient ball across a net. The racket is constructed of a frame having a handle portion gripped by the player, and having a looped head portion with crossed strings for striking the ball, and having an intermediate portion therebetween with beams and a yoke or throat piece coupling the handle and the head.

Tennis racket frames have been traditionally constructed of a large number of materials. Originally they were constructed of wood. Subsequently, metal rackets were utilized to a great extent. More recently, racket frames of composite materials have become popular since they decrease weight and improve playability features in terms of increased strength and stiffness. Composite rackets, however, are expensive. This is because of more complex fabrication techniques. Composite rackets, however, tend to create an excessively large shock or vibration when striking the ball. This is uncomfortable and physically detrimental to the player. Consequently, there is an ever increasing search for superior materials and designs for tennis racket frames in order to maximize playability in terms of strength and reduced weight while minimizing shocks and vibrations when striking a ball. All this is done against a background of minimizing costs.

As illustrated by a great number of patents as well as commercial rackets, efforts are continuing to improve tennis rackets. None of the previous rackets, however, provides the benefits attained with the present invention. Additionally, the prior patents and commercial devices do not suggest the present inventive combination of component elements and materials arranged and configured as disclosed and claimed herein. The present invention achieves its intended purposes, objects and advantages through a new, useful and unobvious combination of component elements, with a use of the minimum number of functioning parts, at a reasonable cost to manufacture, and by employing only readily available material.

Therefore, it is an object of the present invention to provide a tennis racket comprising a head formed as a closed loop at the upper end, a handle for being gripped by a player at the lower end and coupling beams therebetween, the head being formed with varied inertial cross-sectional configurations around its periphery with a nearly circular cross-sectional configuration at the upper edge of the head and the lower edge of the head and with an oval wide-beam cross-sectional configurations at the sides of the head between the 2 and 5 o'clock positions and the 7 and 10 o'clock positions for generating a stiffness that is about 70% of the other sections which have nearly circular cross-sectional configuration and strings in a plane secured in the head.

It is a further object of the present invention to improve tennis rackets by enhancing playability and comfort with a viable combination of power and control.

It is a further object of the present invention to form the head of a tennis racket with a nearly circular cross-sectional configuration at its upper and lower extents and a wide-body oval cross-sectional configuration at its lateral extents.

It is a further object of the present invention to vary the inertia of the head of a tennis racket frame around the periphery of its head.

It is a further object of the present invention to configure the cross-sectional configuration of a racket frame with an air-foil mid-head and essentially circular above and below to effect a wrap-around when striking a ball.

It is a further object of the present invention to configure the frames of tennis rackets to effect varied inertia.

It is a further object of the present invention to improve composite tennis racket frames.

It is a further object of the present invention to minimize shock and vibration of a tennis racket when striking a ball.

It is a further object of the present invention to make hitting tennis balls more comfortable for players.

The foregoing has outlined some of the more pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the attached claims with a specific embodiment shown in the attached drawings. For the purpose of summarizing the invention, the invention may be incorporated into a tennis racket comprising a head formed as a closed loop at the upper end, a handle for being gripped by a player at the lower end and coupling beams therebetween, the head being formed with varied inertial cross-sectional configurations around its periphery with a nearly circular cross-sectional configuration at the upper edge of the head and the lower edge of the head and with an oval wide-beam cross-sectional configurations at the sides of the head between the 2 and 5 o'clock positions and the 7 and 10 o'clock positions for generating a stiffness that is about 70% of the other sections which have nearly circular cross-sectional configuration and strings in a plane secured in the head.

The invention may also be incorporated into a tennis racket frame comprising a head at the upper end, a handle for being gripped by a player at the lower end and coupling beams therebetween, the head being formed as a closed loop for the support of strings in a plane, the cross-sectional configuration of the head being formed with varied inertial cross-sectional configurations around its periphery with a nearly circular cross-sectional configuration at the upper and lower edges of the head and with an oval cross-sectional configurations at the sides of the head for generating a stiffness that is less than that of the other section.

The sides of the head extend between about the 2 and 5 o'clock positions and the 7 and 10 o'clock positions. The sides of the head have a wide-beam, configuration, wider than the remainder of the frame.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

For a fuller understanding of the nature and objects of invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
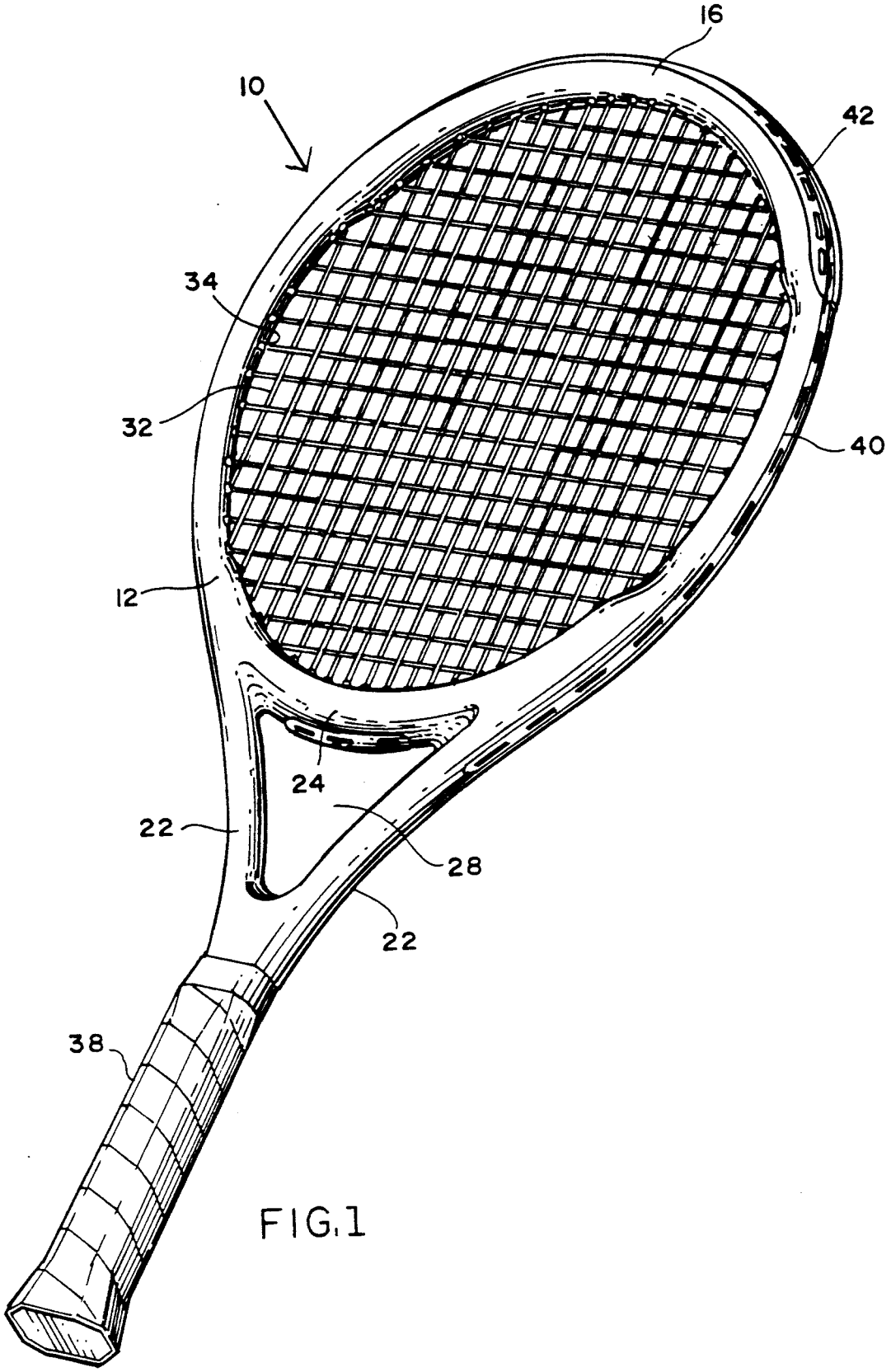
FIG. 1 is a perspective illustration with a racket fabricated in accordance with the principles of the present invention.
Figure 3:
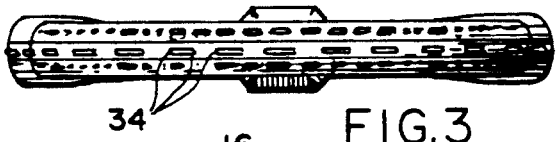
FIGS. 3, 4 and 5 are a top side and bottom views of the racket of FIGS. 1 and 2.
Figure 2:
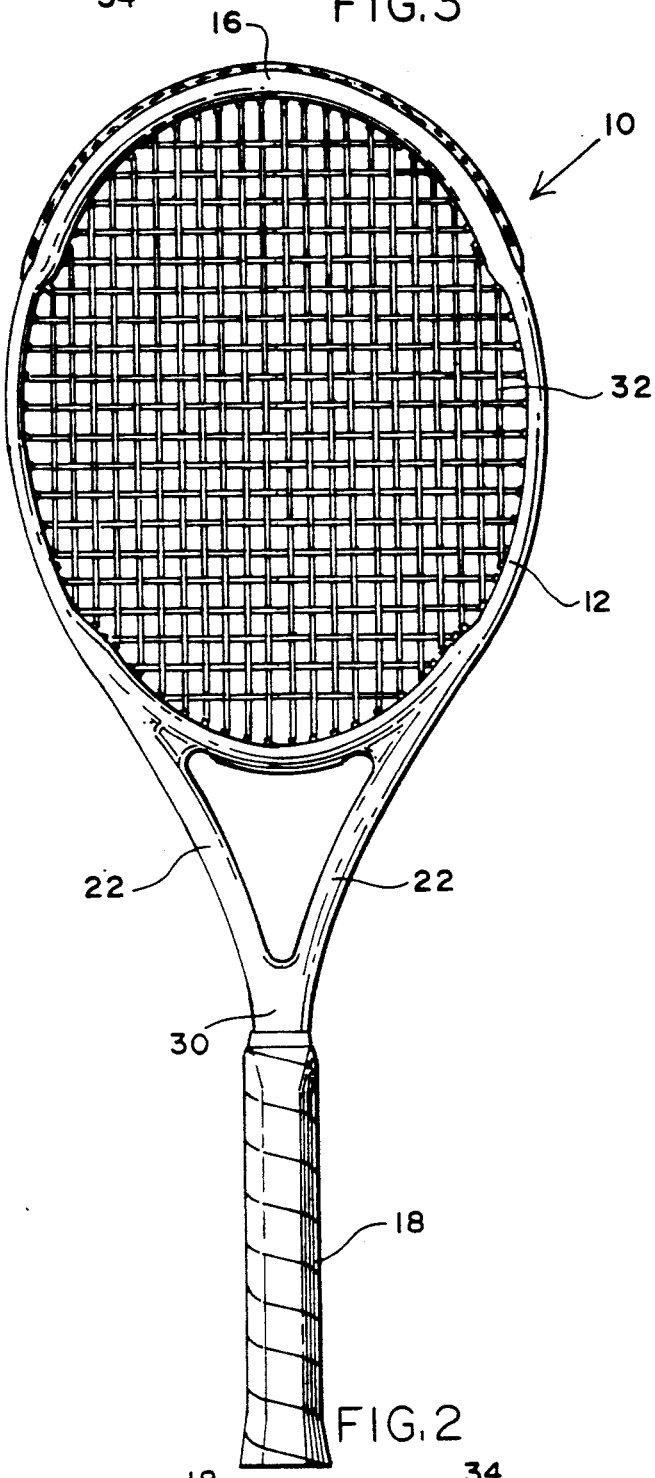
FIG. 2 is a front elevational view of the racket shown in FIG. 1.
Figure 4:
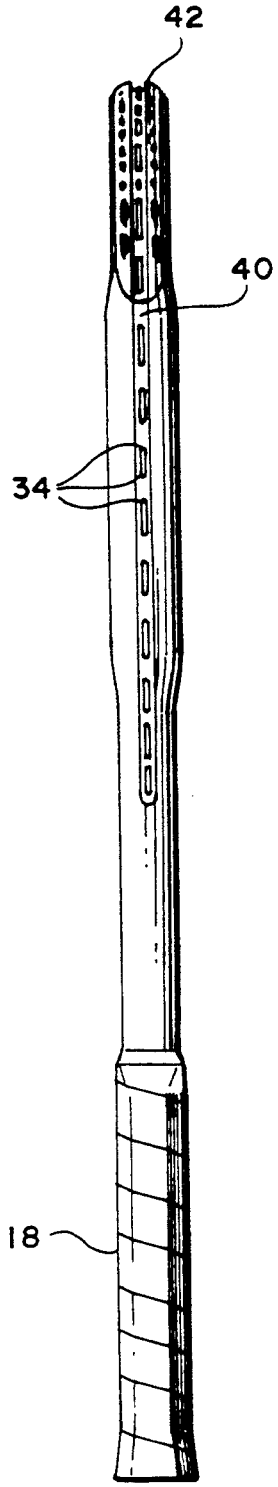
Figure 5:
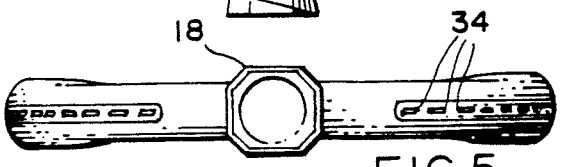

With particular reference to the Figures, there is shown in FIG. 1 a perspective illustration of a tennis racket 10 constructed in accordance with the principles of the present invention. The major component of the tennis racket 10 is the frame 12. The frame 12 is also shown in FIG. 2, a plan view. The frame is constructed of composite materials in a tubular configuration with aligned fibers in an epoxy resin binder. The frame is of a hollow tubular construction shaped in an oval configuration at the head 16 at the head end and with the tubes in parallel, side-by-side relationship at the handle 18 at the handle end. Therebetween, the frame has an intermediate portion or beams 22 coupling the head 16 and the handle 18. A throat piece or yoke 24 closes the head oval at its lower end at the beams 22. The yoke 24 is coupled to the remainder of the frame during the bonding/molding process and thereby becomes an essentially integral component of the frame 12 and racket 10. The beams 22 and yoke 24 form an open throat 28. The area at the top of the handle is also joined together with a plastic insert 30 during the bonding/molding process thus providing a finished frame without any visible seams. The joining of the yoke with the head and the beams is by cohesion, an intermingling of common components including the resin matrix of the cohered materials.

The other significant components of the racket are the strings 32 which are essentially interwoven through holes 34 in the frame and yoke along parallel lines. Main or vertical strings extend parallel with the central axis of the frame and racket. Minor or cross horizontal strings are strung in the head perpendicular to the central axis and are interwoven through the vertical strings. Together the strings lie in a plane and are equally spaced one from another to constitute the striking surface for hitting the ball during play. The main strings are formed from a common first string extending through vertically aligned holes while the minor strings are formed from a common second string extending through horizontally aligned holes.

Another component of the racket is the handle. The handle is fabricated of a molded handle 36 on the frame including polyethylene and graphite fibers which is then covered by spirally wrapped leather or a synthetic grip 38 thereover. Weights, as of lead, may be added to the handle portion of the frame beneath the molded handle for balancing purposes. Such components are conventional in the tennis art.

The head end of the frame is provided with grommet strips 40 and/or a bumper strip 42. The grommet strips 40 are of a moldable, hard, synthetic material such as nylon on the radial exterior of the head at its sides with barrels extending through the head holes through which the strings pass. The bumper strip 42 is also of a similar material and extends radially exterior of the head at its upper extent. It extends axially a greater distance from the frame than the grommet strip to preclude scraping the frame. Such components are conventional in the tennis art.

The yoke 24 of the racket is tubular in construction like the remainder of the frame but is formed separately therefrom in its initial stages. It is layed up on a mandrel. In its preferred form, it is filled with an expanded foam material such as ethyl vinyl acetate (EVA) to give it added strength. It is coupled, at its ends to the inner portion of the frame at the lower extent of the strings. The yoke 24 is configured for fitting tightly in the space at the bottom of the head. Additional tails of graphite/epoxy tape extend from the molded throat piece for contact with the graphite epoxy tape of the frame in the area of contact for increasing and strengthening the bond therebetween. Preferred materials for the binder include epoxy, vinyl ester, polyester, polyurethane, etc. The preferred material for the fibers is monofilament carbon.

Figure 6:
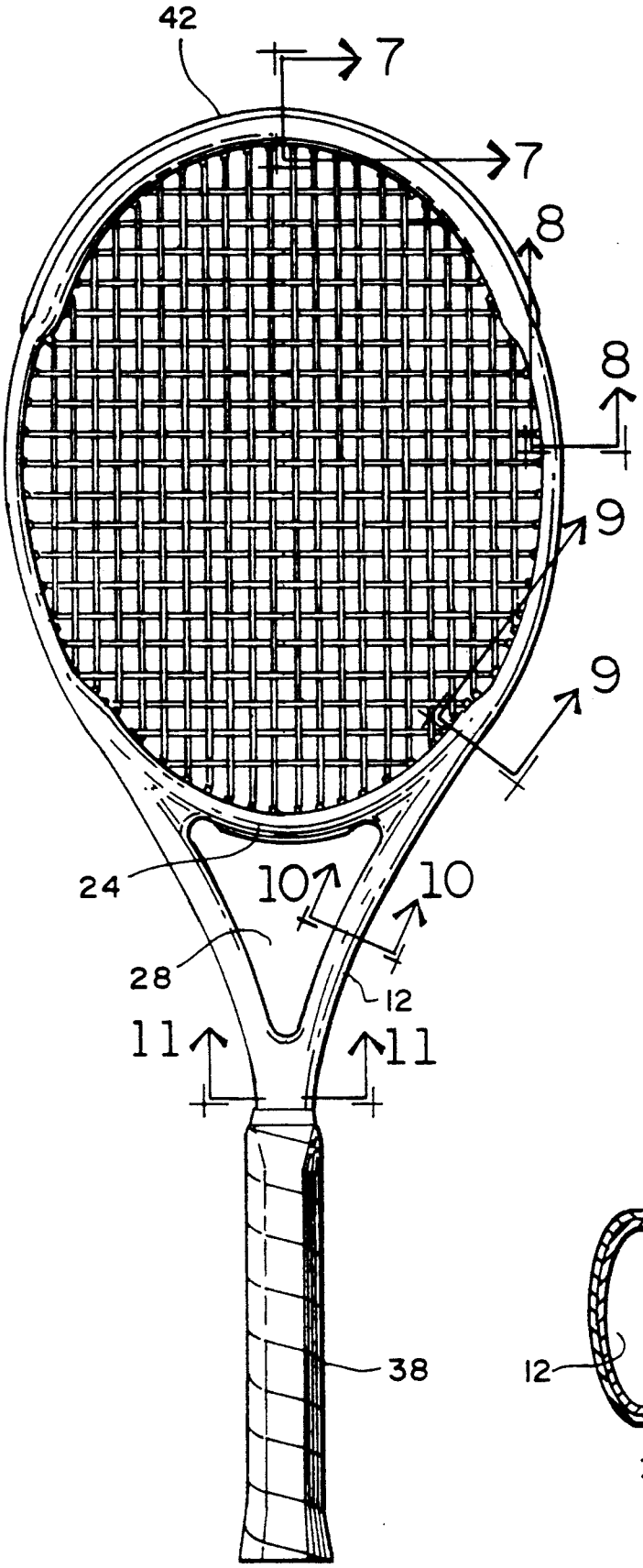
FIG. 6 is a front elevational view of the racket of the prior Figures illustrating various component areas of the racket of the prior Figures.
Figure 7:
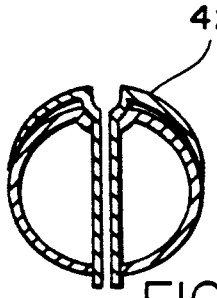
FIGS. 7, 8, 9, 10 and 11 are sectional views of the racket taken along lines 7—7, 8—8, 9—9, 10—10 and 11—11 respectively.
Figure 8:
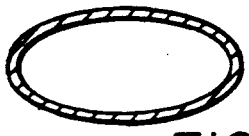

Greater details of construction can be seen in FIGS. 7, 8, 9, 10 and 11 sectional view taken through lines 7—7, 8—8, 9—9, 10—10 and 11—11 of FIG. 6. By way of example, section 7—7 illustrates a section of the racket frame taken through the top of the head. FIG. 8 illustrates section 8—8 through a beam. Sections 9—9, 10—10 and 11—11 are taken through the lower part of the head, the beam and upper part of the handle.

Figure 11:
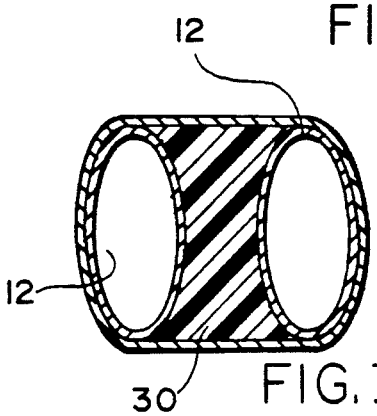

FIG. 11 illustrates the upper handle portion of the frame in cross-section with two parallel tubes spaced a short distance and wrapped with graphite epoxy with a piece of solid expandable foam 30 therebetween. Suitable materials for such solid expandable foam include a thermoplastic matrix with reinforcing fibers of carbon, fiberglass, nylon etc.

From a fabrication standpoint, the tennis racket frame of the present invention is constructed in a conventional manner. The first step includes the providing of a mandrel, a linear piece with a central axis. The mandrel is normally constructed of a solid elongated teflon member, either a single piece or a plurality of pieces coupled together along their lengths as may be needed to accommodate complex shapes with different cross-sectional configuration along the length.

The mandrel is then wound with layers or strips of the composite material which will constitute the racket frame. Adjacent to the interior surface of the formed strips is a thin air bladder which may be initially placed on the mandrel prior to the winding. It may also be placed within the winding after the mandrel is removed. The air bladder is a thin tubular member of air impervious material which is not stretchable. It is preferably made of a silicone material which is resistant to high temperatures.

After the mandrel is removed, and the with the bladder in place, the windings are bent to the intended configuration corresponding to the frame of the tennis racket to be fabricated. In additional to the preparation of the main portion of the frame to be placed in the mold, there is a second and separate piece, the yoke, which is fabricated in a similar manner with a bladder inside. In place of the bladder, EVA material may be placed inside the hollow yoke. The composite strips and the interior bladder are then placed into a dummy mold with the frame and yoke tied together with composite material whereby the pieces correspond to the shape of the finished racket frame. In additional, a nipple is added to the end of the frame of the bladder to allow the blowing of air into interior of the strips in contact with the mold for shaping during curing. The mold is then closed and placed into a platen where heat and pressure cause the windings and yoke to cure for generating the final product. Heating is done by conduction for quick and uniform heating. Upon taking the final product out of the platen and then the mold, there is no need to remove the bladder. The extreme end pieces of the windings is then cut off to remove the nipple.

In the preferred embodiment the preimpregnated sheets are drum rolled. Fibers are separated by a coat of resin. This coat can vary in thickness, depending on fiber tension, drum speed and resin viscosity.

The process of laying up the component composite strips involves placing a plurality of strips of composite material over the mandrel, one on top of the other. The axis of each single strip overlies the axis of the mandrel and represents the radially interior surface of the finished frame and racket.

Figure 12:
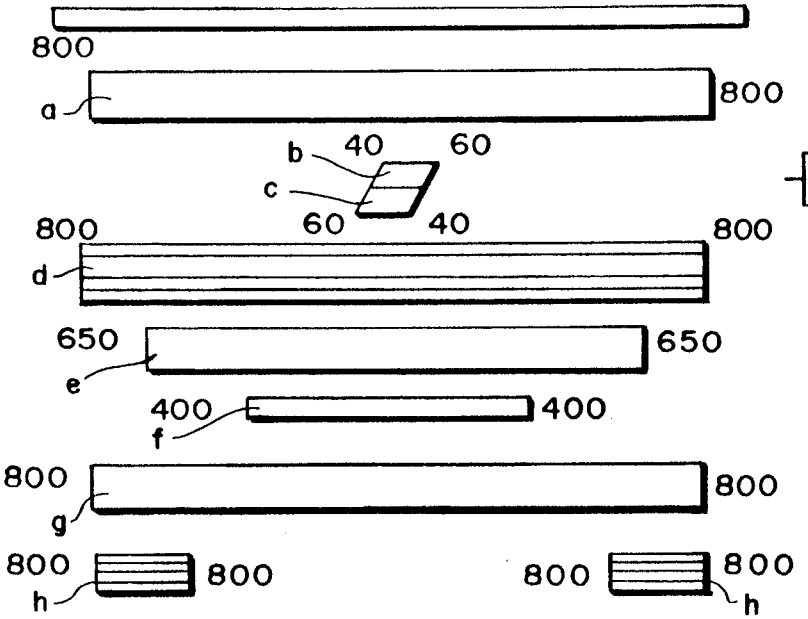
FIGS. 12 and 13 are layup drawings of the materials used to fabricate the frame of the tennis racket of the prior Figures.
Figure 13:
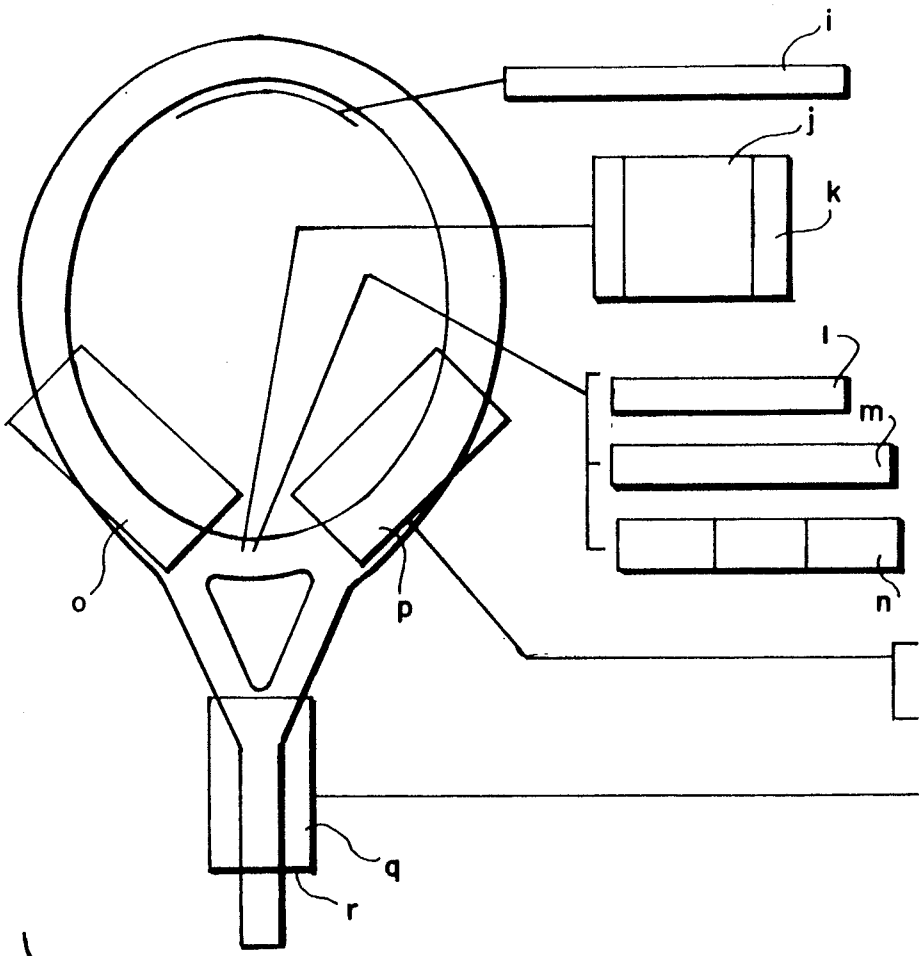

The strips may be considered in as being of two types, the first type shown on FIG. 12 relates to the basic strips while the strips shown in FIG. 13 relate to the strengthening strips. The basic strips are eight in number and are identified as a through h. The first strip a is layed on the bladder and is composed of resin matrix material with carbon fibers aligned at about 19 degrees from the axis of the mandrel. Actually, the 19 degree fibers include two layers of fibers, one at plus 19 degrees and the other at minus 19 degrees from the mandrel axis. The two layers of fibers are employed for all angled fibers. This first layer or strip is 100 millimeters long by 160 millimeters wide. Actually two such plys are utilized one over top of the other. Note this designation at the beginning of the third column of the charts of FIGS. 12 and 13. The fiber area weight (F.A.W.) is 110 grams per square meter. These features are also found in column 3 of FIGS. 12 and 13. The total part weight 64.0 grams are shown in column 4. The second strip, the strip b, is in the shape of a parallelogram with 0 degree carbon fibers. It is 65 millimeters wide and 100 millimeters long. Its upper edge is spaced from the vertical center line 40 millimeters in one direction and 60 millimeters in the other while its lower edge is 50 millimeters in one direction and 50 millimeters in the other. The third strip c is also in the shape of a parallelogram but has its carbon fibers aligned at about 30 degrees. Like the first parallelogram strip b it is 65 millimeters wide and 100 millimeters in length but with its upper edge 50 millimeters to one side of the vertical line and 50 millimeters to the other with its lower edge 60 millimeters on one side and 40 millimeters to other. Actually two such superimposed strips c are preferably utilized. The fourth strip, strip d, and subsequent strips are layed one over the other to complete the layup. The last strip, strip h, is actually a pair of 0 degree strips 60 millimeters in width and 200 millimeters in length. They are spaced equally distanced from the center line by a distance of 600 millimeters. The parenthetical numbers in the FIG. 12 chart are those prior to trimming following removal from the mold.

The second grouping of strips, strips designated as i through r, are layed over the primary grouping of strips shown in FIG. 12 for selective strengthening. Note FIG. 13. These strips and their sizes, locations and characteristics are shown in the chart of FIG. 12.

Figure 10:
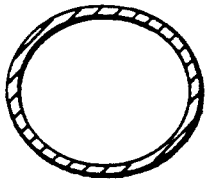

The various sections have configurations as follows:

1) Section 11—11 as shown in FIG. 11; 20 millimeters by 30 millimeters in a rectangle 2) Section 10—10 as shown in FIG. 10;

| | |
|---|---|
| a = 10 | ai = 9.0 millimeters |
| b = 8.5 | bi = 7.5 millimeters |

Figure 9:
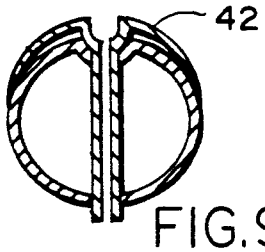

3) Section 9—9 which is the same as 7—7, as shown in FIG. 9;

| | | |
|---|---|---|
| a = 1 | ai = 10 | tmin = 1.0 mm |
| b = 9 | bi = 8 | |

4) Section 8—8 as shown in FIG. 8;

| | |
|---|---|
| a = 13 | ai = 12 |
| b = 5.8 | bi = 4.8 |

The present construction creates a racket with a head having stiffness variance in the transverse planes. This will create a wrap around effect when the ball is struck. The throat is nearly circular. The lower head also is nearly circular, gradually changing to an air foil at the mid-head, and then back to a nearly circular profile at the top of the head. The air foil section will be less stiff in bending in the transverse plane, and the resulting deflection will have a softer feel and more elastic feel when the ball is struck. This design concept will create the same stability effort as adding weights at three and nine o'clock on the head. The weight penalty, however, is eliminated.

The present invention is in a racket whose frame features an innovative optimized profile designs to enhance playability and comfort while providing a viable combination of power and control. The racket is constructed with 100% ultra-high modulus graphite fibers (UHMGF) and features a frame cross-section that exhibits varied area moment of inertia (VAMI). This inertial varied provide excellent combination levels of stability, power control and comfort.

The design features of the preferred embodiment a round cross-section at the throat or yoke to enhance stability. The round body cross-section continues up the racket shoulders to the 5 and 7 o'clock positions where the cross-section gradually changes to a wide-body profile, 26 mm and continues up the racket head to the 2 and 10 o'clock positions where the cross-section becomes round again. The variation of area moment of inertia was studied in detail by via computer generated analyses before finally settling on the optimum cross-section variations.

The cross-section is designed in such a way that the frame stiffness is the same the whole length of the racket which is the same stiffness in the plane of the string bed plane. In the plane perpendicular to the string bed plane, however, has the frame sections between about 2 and 5 o'clock and between about 7 and 10 o'clock exhibit a stiffness that is about 70% of the other sections.

This inertial variation increases the aspect ratio (AR) of the string bed without having to make the racket head excessively round. In addition to an increased aspect ratio, the present design increases the lengths of the outer main strings to provided for a more evenly distributed string bed deformation or deflection when the ball is struck.

This combination of greater aspect ratio value and uniform string bed deflection adds control and consistency of feel to the shot response of this racket. Also, the longer outer main strings give more resiliency to the string bed creating a larger power zone or sweet spot.

The transverse stiffness reduction between 2 and 5 o'clock and 7 and 10 o'clock serves as a kinetic stabilizer on off-center shots. These areas deflect inwards to prevent torsional energy from traveling down the frame towards the throat that would otherwise create instability.

This racket described above, the preferred embodiment, has a 103 square inches head size. It has a firm flex and head light balance and weighs 325 grams unstrung.

Although the present invention includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

What is claimed is:

1. A tennis racket comprising a head formed as a closed loop at the upper end, a handle for being gripped by a player at the lower end and coupling beams therebetween, the head being formed with varied inertial cross-sectional configurations around its periphery with a nearly circular cross-sectional configuration at the upper edge of the head and the lower edge of the head and with oval wide-beam cross-sectional configurations at the sides of the head between the 2 and 5 o'clock positions and the 7 and 10 o'clock positions for generating a stiffness that is about 70% of the stiffness at the upper edge of the head and the lower edge of the head which have nearly circular cross-sectional configurations and strings in a plane secured in the head.

2. A tennis racket frame comprising a head at the upper end, a handle for being gripped by a player at the lower end and coupling beams therebetween, the head being formed as a closed loop for the support of strings in a plane, the cross-sectional configuration of the head being formed with varied inertial cross-sectional configurations around its periphery with a nearly circular cross-sectional configuration at the upper and lower edges of the head and with oval cross-sectional configurations at the sides of the head for generating a stiffness that is less than the stiffness at the upper and lower edges of the head.

3. The frame as set forth in claim 2 wherein the sides of the head extend between about the 2 and 5 o'clock positions and the 7 and 10 o'clock positions.

4. The frame as set forth in claim 2 wherein the sides of the head have a wide-beam, configuration, wider than the remainder of the frame.

* * * * *